US006430888B1

(12) United States Patent
Dombchik et al.

(10) Patent No.: US 6,430,888 B1
(45) Date of Patent: Aug. 13, 2002

(54) ALUMINUM FRAMING COMPONENTS AND COMPONENT SYSTEMS FOR POOL, PATIO AND GLASS ENCLOSURES AND THE LIKE

(75) Inventors: Barry N. Dombchik, Longwood; Terry L. Brownlee, North Port, both of FL (US)

(73) Assignee: Florida Extruders International, Inc., Sanford, FL (US)

( * ) Notice: Subject to any disclaimer, the term of this patent is extended or adjusted under 35 U.S.C. 154(b) by 0 days.

(21) Appl. No.: 09/578,654

(22) Filed: May 25, 2000

Related U.S. Application Data

(63) Continuation-in-part of application No. 09/024,531, filed on Feb. 17, 1998, now Pat. No. 6,092,348.

(51) Int. Cl.[7] ..... E04H 12/00

(52) U.S. Cl. ..... 52/653.1; 52/656.5

(58) Field of Search ..... 52/656.1, 656.5, 52/656.9, 726.1, 726.2, 653.1, 648.1, 653.2, 655.1, 204.71, 204.72

(56) References Cited

U.S. PATENT DOCUMENTS

| | | | | | |
|---|---|---|---|---|---|
| 3,749,432 | A | * | 7/1973 | Janssen | 52/238 |
| 4,038,791 | A | * | 8/1977 | Atkinson | 52/36 |
| 4,462,390 | A | * | 7/1984 | Holdridge | 52/82 |
| 4,493,172 | A | * | 1/1985 | Jones | 52/220 |
| 5,644,881 | A | | 7/1997 | Neilly | |
| 5,655,348 | A | * | 8/1997 | Paradise | 52/656.4 |
| 5,657,591 | A | | 8/1997 | Kitada | |
| 5,893,245 | A | * | 4/1999 | Sekiguchi | 52/235 |
| 6,092,348 | A | * | 7/2000 | Dombchik | 52/653.1 |
| 6,128,876 | A | * | 10/2000 | Nitschke | 52/239 |

FOREIGN PATENT DOCUMENTS

| | | | |
|---|---|---|---|
| JP | 3191140 | * 12/1989 | 52/656.6 |

* cited by examiner

*Primary Examiner*—Beth A. Stephan
(74) *Attorney, Agent, or Firm*—Renner, Otto, Boisselle & Sklar, LLP

(57) ABSTRACT

Aluminum framing components comprise both hollow aluminum extrusions and open back aluminum extrusions which may be used separately or as a system. The hollow aluminum extrusions have a total of three screw bosses, two of which oppose each other on the side walls above the center of gravity of the extrusions and the third of which is located in close proximity to the bottom center of the extrusions below the center of gravity of the extrusions. A U-shaped clip may be fitted between these screw bosses to prevent the hollow aluminum extrusions from twisting or rocking during installation of the hollow aluminum extrusions to an upright such as an other hollow framing component and also permit field attachment of the hollow aluminum extrusions to such other hollow framing component upright for use as a chair rail or the like. One form of open back aluminum extrusion has a face with flat, uninterrupted inner and outer surfaces to facilitate placing of the end of other framing components against the outer surface of the face and the flush mounting of fasteners against the inner surface of the face with the fasteners running through the face into screw bosses in the other framing components. Another form of open back aluminum extrusion includes a pair of laterally spaced legs integrally formed on the inner surface of the face of the extrusion for selective attachment of relatively short lengths of screw boss adapters to such inner surface to permit fasteners to be used with such extrusion in internal horizontal fastening applications and when panel sections including such extrusions are prefabricated at the factory rather than built at the job site.

30 Claims, 5 Drawing Sheets

ALUMINUM FRAMING COMPONENTS AND COMPONENT SYSTEMS FOR POOL, PATIO AND GLASS ENCLOSURES AND THE LIKE

CROSS-REFERENCE TO RELATED APPLICATIONS

This application is a continuation-in-part of U.S. patent application Ser. No. 09/024,531, filed Feb. 17, 1998, now U.S. Pat. No. 6,092,348, dated Jul. 25, 2000.

FIELD OF THE INVENTION

This invention generally relates to aluminum framing components and systems including such components for use in the construction of pool, patio and glass enclosures and the like.

BACKGROUND OF THE INVENTION

A variety of different sizes and shapes of aluminum framing components are commonly used in the construction of pool, patio and glass enclosures. Historically 2×2 hollow aluminum extrusions (which typically have outside dimensions of 1.98 inches×1.98 inches) have had the widest applications in these installations, being used in screen enclosures for pools as purlins, chair rails and top rails, and as uprights at corners and around doorways, and being used in screen and glass rooms or patio enclosures as top rails, beams, chair rails and uprights and the like. Of course, standard industry tolerances apply to all extrusion dimensions set forth in this application.

The industry standard 2×2 hollow aluminum extrusions currently in use have four internal screw bosses, two on each side wall, intended to receive fasteners for anchoring the extrusions to other framing components. A drawback to this design is that sometimes the contractor installs less than four fasteners, which can have an adverse effect on the structural load capacity and thus the span capability of the extrusion. A minimum of three tightly secured fasteners is required to prevent the extrusions from rocking under load.

Another drawback to the industry standard 2×2 hollow aluminum extrusions is that the fasteners either have a tendency to strip out of the screw bosses, or a twist condition occurs when the fasteners are run into the screw bosses, resulting in noticeable lines in the side walls of the extrusions behind the screw bosses which are unacceptable from an aesthetics standpoint in that the lines make it appear as if the fasteners are breaking out of the extrusion walls.

Another aluminum framing component that is widely used in screened patio and pool enclosures to hold the screens in at the top and bottom edges and at the corners of the enclosures is a 1×2 open back aluminum extrusion (commonly referred to as a solid aluminum extrusion), which typically has outside dimensions of 0.990 inch×1.98 inches. The industry standard 1×2 open back solid aluminum extrusions include two internal screw bosses that are sometimes used to anchor the extrusions to other framing components. However, the screw bosses in the open back extrusions can be a hindrance especially when attaching the ends of hollow aluminum extrusions to the face of the open back extrusions by running fasteners through the face into the screw bosses in the hollow aluminum extrusions in that the screw bosses in the open back extrusions prevent the fasteners from being flush mounted up against the inside surface of the face of the open back extrusions, thus necessitating the use of longer fasteners.

SUMMARY OF THE INVENTION

The present invention relates to certain improvements in the design and construction of the aforementioned aluminum framing components for use in the construction of pool, patio and glass enclosures and systems including such framing components.

In accordance with one aspect of the invention, one of the framing components comprises a hollow aluminum extrusion having a total of three screw bosses instead of the usual four, which not only reduces the cost of the extrusions, but also the cost of the labor and material in installing the extrusions in that only three fasteners have to be installed instead of the usual four.

In accordance with another aspect of the invention, two of the screw bosses oppose each other on the side walls of the hollow aluminum extrusion above the center of gravity of the extrusion, whereas the third screw boss is strategically located in close proximity to the bottom center of the extrusion below the center of gravity of the extrusion to optimize the structural capacity of the extrusion for a given shape and nominal wall thickness, resulting in an improved rigid moment connection with other framing components using a minimal number of fasteners.

In accordance with another aspect of the invention, the nominal wall thickness of the three screw bosses and extrusion walls directly behind the screw bosses are made thicker than the nominal wall thickness of the hollow aluminum extrusion to give the extrusion a greater moment of inertia and section modulus than the standard four screw boss hollow aluminum extrusion with equivalent nominal wall thickness and thus a greater span capability.

In accordance with another aspect of the invention, the increased nominal wall thickness of the screw bosses and walls of the hollow aluminum extrusion directly behind the screw bosses allow the nominal wall thickness and thus the cost of the hollow aluminum extrusion to be reduced without adversely affecting the structural integrity of the extrusion profile.

In accordance with another aspect of the invention, the screw bosses in the hollow aluminum extrusion are sized and shaped to prevent a twist condition from occurring and also prevent the fasteners from stripping out of the screw bosses when the fasteners are run into the screw bosses.

In accordance with another aspect of the invention, the nominal wall thickness of the screw bosses and extrusion walls directly behind the screw bosses are made thicker than the nominal wall thickness of the hollow aluminum extrusion to provide greater structural integrity to the screw bosses and virtually eliminate any appearance that the fasteners may be breaking out of the walls of the extrusion, thus enhancing the surface condition and overall aesthetics of the extrusion.

In accordance with another aspect of the invention, a U-shaped internal clip may be fitted between the screw bosses of a hollow aluminum extrusion to permit field attachment of the hollow aluminum extrusion to an upright such as a hollow post for use as a chair rail or the like.

In accordance with another aspect of the invention, the U-shaped internal clip may be fitted between the screw bosses of the hollow aluminum extrusion to prevent the hollow aluminum extrusion from twisting or rocking during installation of the hollow aluminum extrusion to an upright such as an other hollow framing component.

In accordance with another aspect of the invention, another framing component comprises an open back aluminum extrusion having a face with flat, uninterrupted inner and outer surfaces to facilitate the flush mounting of fasteners against the inner surface of the face and the running of the fasteners through the face in alignment with screw bosses in other framing components.

In accordance with another aspect of the invention, the open back aluminum extrusion of the present invention may be secured to the three screw boss hollow aluminum extrusion of the present invention or to other hollow aluminum extrusions as a system with an end of the hollow aluminum extrusion engaging the outer surface of the face of the open back extrusion, and fasteners flush mounted against the inner surface of the face and running through the face into the screw bosses in the hollow aluminum extrusion.

In accordance with another aspect of the invention, the bottom wall screw boss in the hollow aluminum extrusion of the present invention is spaced from the bottom wall by an integral stem to provide clearance for the head and washer of the fastener that runs through the face of the open back aluminum extrusion into the bottom wall screw boss of the hollow aluminum extrusion.

In accordance with another aspect of the invention, the side walls of the open back aluminum extrusion of the present invention that extend outwardly from the face have relatively short mounting legs on the outer ends thereof so as not to interfere with the insertion of one of the fasteners through the face into the bottom wall screw boss in the hollow aluminum extrusion.

In accordance with another aspect of the invention, a pair of laterally spaced legs are integrally formed on the inner surface of the face of another form of open back aluminum extrusion in accordance with the present invention to permit relatively short lengths of screw boss adapters to be attached to such inner surface to allow fasteners to be used with the open back aluminum extrusion in internal horizontal fastening applications and when panel sections including such open back aluminum extrusions are prefabricated at the factory rather than assembled at the job site.

In accordance with another aspect of the invention, the internal legs extend the full length of the open back aluminum extrusion in closely spaced relation on opposite sides of the axial center of the open back aluminum extrusion to provide added rigidity in the area of the profile of the open back aluminum extrusion that is subject to a cave-in effect caused by the fasteners being torqued with an automatic screw gun.

In accordance with another aspect of the invention, the internal legs of the open back aluminum extrusion have sufficient spacing therebetween for accepting suitable fasteners therebetween.

In accordance with another aspect of the invention, the screw boss adapters, when attached to the inner surface of the face of the open back aluminum extrusion, provide increased wall thickness at the attachment points thus adding shear protection during tightening of fasteners into the screw boss adapters, lessening cave-in effect, and providing reinforcement to the upright connections of the enclosure.

In accordance with another aspect of the invention, the open back aluminum extrusion with internal legs of the present invention can be used without the screw boss adapters at a lower material cost compared to the industry standard open back aluminum extrusions with screw bosses.

In accordance with another aspect of the invention, the open back aluminum extrusion with internal legs of the present invention eliminates the need for a contractor having to stock both the industry standard open back aluminum extrusion with screw bosses and the open back aluminum extrusion of the present invention with uninterrupted inner face surface which does not have the ability to accept screw boss adapters.

In accordance with another aspect of the invention, the two legs on the inner face of the open back aluminum extrusion of the present invention are in closely spaced relation to each other (with enough spacing therebetween for accepting a fastener therebetween) to provide sufficient room between the legs and adjacent sides of the open back aluminum extrusion for locating fasteners used to secure the open back aluminum extrusion to an other framing component away from the center of the face of the open back aluminum extrusion to prevent slippage of the inturned ends of the open back aluminum extrusion around the adjacent edges of the other framing component.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 2 is an enlarged end view of a standard 2×2 hollow aluminum extrusion used in the construction of pool, patio and glass enclosures and the like;

FIG. 10 is an enlarged end view of a standard 1×2 open back aluminum extrusion used in the construction of pool, patio and glass enclosures and the like;

DETAILED DESCRIPTION OF THE PREFERRED EMBODIMENTS

Figure 1:
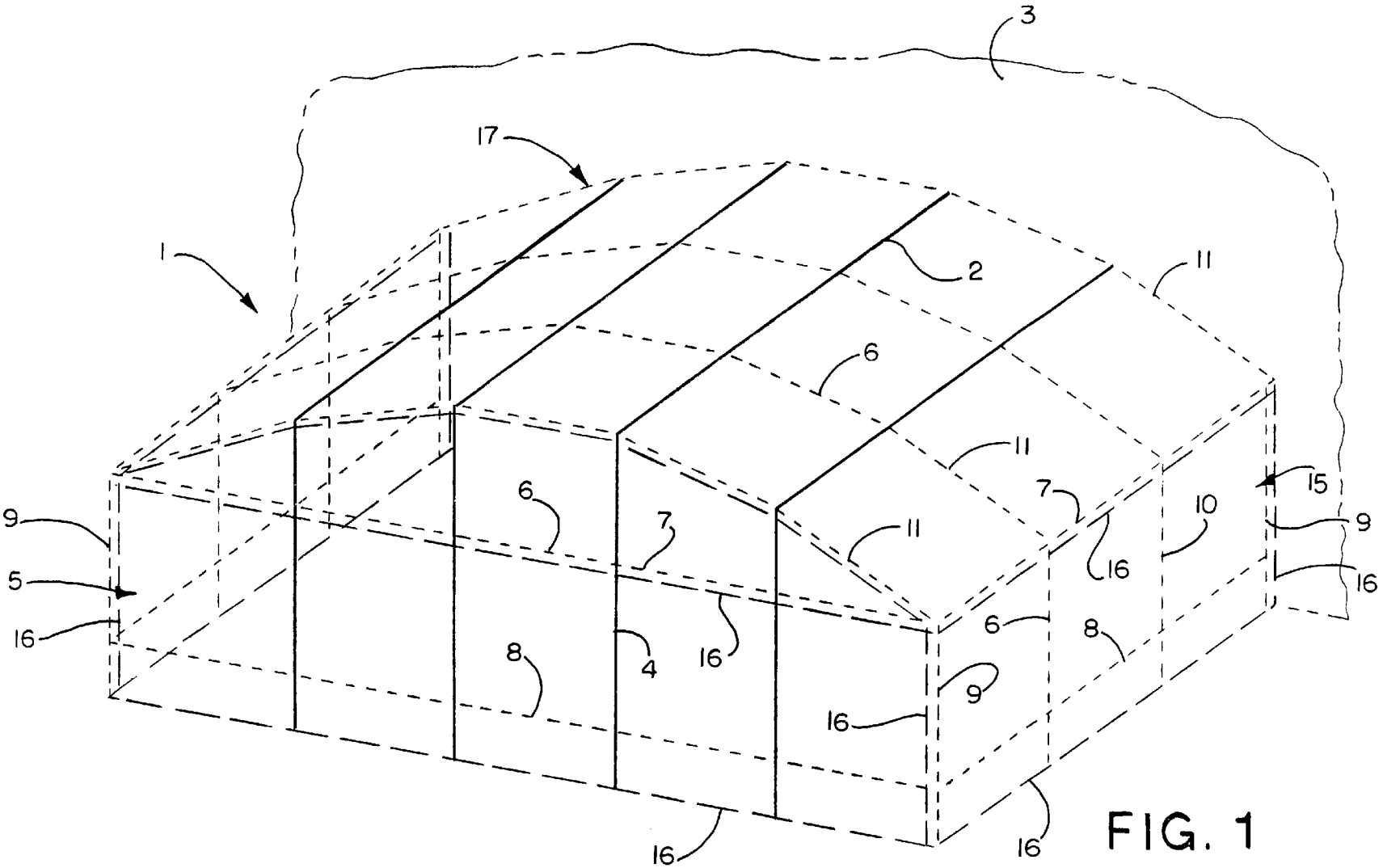
FIG. 1 is a schematic perspective view of one form of enclosure comprised of a plurality of aluminum framing components and component systems.

Referring now in detail to the drawings, and initially to FIG. 1, there is schematically shown one form of pool enclosure 1 constructed of various aluminum framing components including roof beams 2, shown in solid lines in FIG. 1, extending from an existing structure 3 to primary uprights 41 also shown in solid lines, at the front wall 5 of the enclosure. In addition, the enclosure 1 includes numerous 2×2 hollow aluminum extrusions 6, shown in dashed lines, used for top rails 7, chair rails 8, corner posts 9, side wall uprights 10 and purlins 11 to transfer loads and maintain spacing between the primary structural members 2 and 4. Extending along the bottom of the side walls 15 and front wall 5 of the enclosure 1 as well as beneath the top rails 7 and front wall purlins 11 and alongside the corner posts 9 are 1×2 open back aluminum extrusions 16, shown in longer dashed lines in FIG. 1, for use in attaching screens at these points.

The particular enclosure 1 shown in FIG. 1 has a dome shape roof 17. However, it will be appreciated that the roof may be of other shapes including mansard, gable, flat, gable/hip and shed. Moreover, the enclosure may be of other types including patio and glass enclosures and the like.

Figure 2:
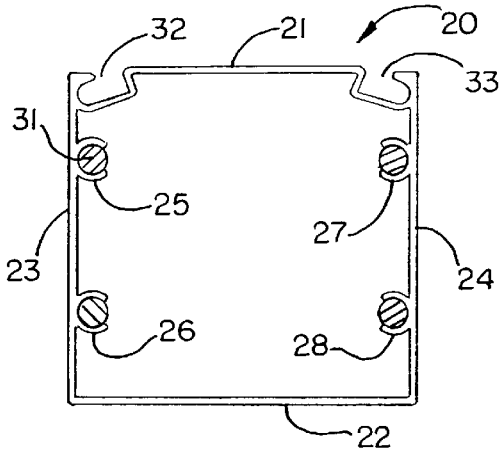
Figure 2A:
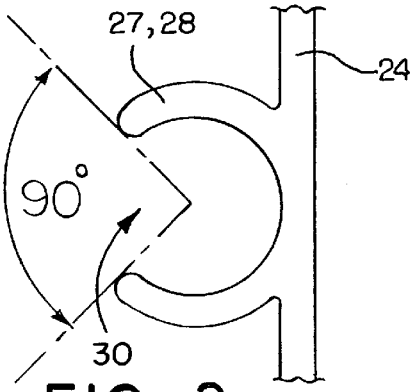
FIG. 2*a* is a further enlarged fragmentary end view of a portion of one of the side walls and one of the screw bosses of the standard hollow aluminum extrusion shown in FIG. 2.

An industry standard 2×2 hollow aluminum extrusion 20 that is commonly used for the hollow aluminum extrusions 6 of FIG. 1 in the construction of pool, patio and glass enclosures is shown in FIG. 2, and includes top and bottom walls 21 and 22 and two side walls 23 and 24. Integral with the inner surfaces of each side wall are two screw bosses 25, 26 and 27, 28. The two screw bosses 25, 26 on side wall 23 are opposite the two screw bosses 27, 28 on the other side wall 24. All four screw bosses 25 through 28 have a nominal wall thickness corresponding to the nominal wall thickness of the extrusion profile, which in most cases is 0.036 inch but in certain applications may be of different nominal wall thicknesses. Also, as best seen in the enlargement of one of the screw bosses in FIG. 2*a*, the nominal thickness of the side walls 23, 24 directly behind the screw bosses 25 through 28 is the same as the nominal wall thickness of the extrusion.

The outside dimensions of the standard 2×2 hollow aluminum extrusion are typically 1.98 inches×1.98 inches. The centers of the two lower and two upper screw bosses 26, 28 and 25, 27 are located 0.552 inch above and below the outer surfaces of the respective bottom and top walls 22 and 21 and 0.120 inch inwardly of the outer surfaces of the side walls 23 and 24. Each screw boss has an inner diameter of 0.168 inch and an opening 30 of 90° for receipt of No. 10 fasteners 31. In the top wall 21 of the extrusion 20 are two spline grooves 32, 33 for rolling of splined edges of screens into the grooves.

A drawback to the industry standard hollow aluminum extrusion 20 shown in FIG. 2 is that sometimes the contractor installs fasteners in less than all four of the screw bosses 25 through 28, which can have an adverse effect on the structural load capacity and thus the span capability of the extrusion. Moreover, there is a tendency for the fasteners 31 either to strip out of the screw bosses, or to produce a twist condition when the fasteners are run into the screw bosses, resulting in noticeable lines in the side walls 23, 24 of the extrusions 20 directly behind the screw bosses, giving the appearance that the fasteners are breaking out of the extrusion profile.

Figure 3:
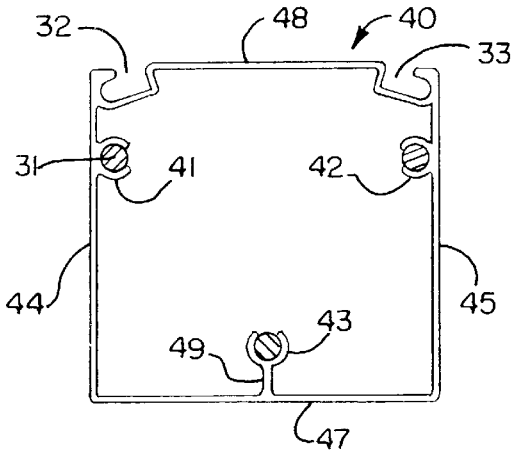
FIG. 3 is an enlarged end view of one form of hollow aluminum extrusion in accordance with the present invention.

To overcome these objections, a 2×2 hollow aluminum extrusion 40 in accordance with this invention is shown in FIG. 3, which only has three internal screw bosses 41, 42 and 43 instead of the usual four. Two of the screw bosses 41 and 42 are integrally formed on the inner surfaces of the two side walls 44 and 45 above the center of gravity of the extrusion, similar to the upper pair of screw bosses 25 and 27 of the standard hollow aluminum extrusion 20 shown in FIG. 2. However, the third screw boss 43 is integrally connected to the bottom wall 47 of the extrusion 40 intermediate the width thereof so as to locate the center of the third screw boss 43 further below the center of gravity of the extrusion 40 than the other two screw bosses 26 and 28 of the standard extrusion 20.

In one embodiment disclosed herein, the outer dimensions of the hollow aluminum extrusion are 1.98 inches×1.98 inches, and the centers of the two side wall screw bosses 41 and 42 are located 0.552 inch from the outer surface of the top wall 48, which is the same as the upper two side wall screw bosses 25 and 27 of the standard extrusion 20. However, the center of the third screw boss 43 is 0.324 inch above the outer surface of the bottom wall 47, leaving a moment arm of 1.104 inch between the two upper side wall screw bosses 41 and 42 and bottom wall screw boss 43. In contrast, the centers of the lower two side wall screw bosses 26 and 28 of the standard extrusion 20 are 0.552 inch above the outer surface of the bottom wall 22, leaving a moment arm of 0.876 inch between the two pairs of side wall screw bosses on opposite sides of the center of gravity of the extrusion.

Providing a single screw boss at the center of the bottom wall of the extrusion maximizes the moment arm between the screw bosses on opposite sides of the center of gravity of the extrusion, thus optimizing the structural capacity of the extrusion for a given shape and nominal wall thickness resulting in an improved rigid moment connection with other framing components. Also, locating the three screw bosses on three of the walls instead of the usual four on two of the walls insures that the contractor will install fasteners in all three screw bosses. Moreover, providing only three screw bosses instead of the usual four lowers the cost of the extrusions and number of fasteners required to anchor the extrusions and thus the length of time it takes to anchor the extrusions in place resulting in a savings of both labor and material.

Figure 3A:
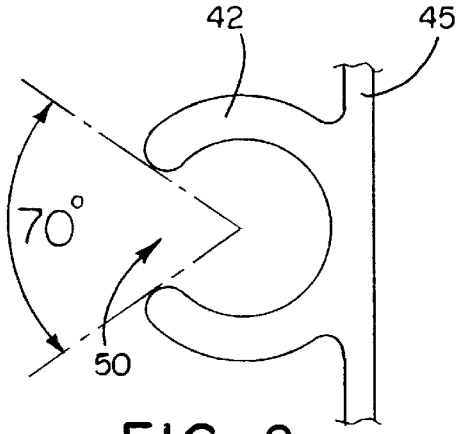
FIG. 3*a* is a further enlarged fragmentary end view of a portion of one of the side walls and one of the screw bosses of the hollow aluminum extrusion shown in FIG. 3.

As shown in the FIG. 3*a* enlargement of one of the walls of the extrusion 40 of FIG. 3, the nominal wall thickness of the screw bosses 41, 42 and 43 of the hollow aluminum extrusion 40 of the present invention and extrusion walls directly behind the screw bosses are greater than the nominal wall thickness of the extrusion. This gives the extrusion a greater moment of inertia and section modulus and thus a greater span capability than the standard four screw boss hollow aluminum extrusion 20 shown in FIG. 2 with an equivalent nominal wall thickness. Moreover, increasing the nominal wall thickness of the screw bosses and walls of the extrusion directly behind the screw bosses allows the nominal wall thickness of the hollow aluminum extrusion to be reduced to provide a cost savings without adversely affecting the structural integrity of the extrusion profile.

In one embodiment disclosed herein, the nominal wall thickness of the screw bosses 41, 42 and 43 of the extrusion 40 has been increased from the standard nominal 0.036 screw boss thickness to 0.040 inch. Also, the nominal wall thickness directly behind the side wall screw bosses 41 and 42 has been increased to 0.044 inch, to make it somewhat thicker than the screw boss nominal wall thickness. The nominal wall thickness of the extrusion 40 may, if desired, be reduced from 0.036 inch to 0.032 inch to reduce material costs. However, making the nominal wall thickness of the extrusion 40 0.036 inch will allow the extrusion profile to achieve greater spans than when the nominal wall thickness of the extrusion 40 is reduced to 0.032 inch and will perform even better compared to the industry standard 2×2 hollow aluminum extrusion shown in FIG. 2 with four screw bosses and a nominal wall thickness of 0.036 inch. The centers of the two side wall screw bosses 41 and 42 are located 0.128 inch from the outer surface of the side walls 44 and 45.

The bottom wall screw boss 43 is connected to the center of the bottom wall 47 of the extrusion 40 by an integral stem 49 that also increases the nominal wall thickness of the extrusion directly behind the bottom wall screw boss. The stem 49 has a nominal wall thickness of 0.040 inch and radiused corners where the stem connects to the screw boss 43 and bottom wall 47.

The inside diameters of the thicker walled screw bosses 41, 42 and 43 of the present invention have been increased slightly from the standard 0.168 inch inside diameter screw bosses to 0.170 inch to provide some relief for the No. 10 fasteners 31 that are normally used to anchor the hollow aluminum extrusions in place. This helps prevent a twist condition from occurring which is possible when No. 10 fasteners are run into the smaller inside diameter screw bosses. Also, a 70° opening 50 is provided in the walls of the screw bosses 41, 42 and 43 as schematically shown in FIG. 3*a* which is enough to allow the fasteners 31 to run easily into the screw bosses and still have the screw bosses sufficiently closed around the fasteners to help prevent the fasteners from stripping out of the screw bosses thereby resulting in better anchoring of the fasteners in the screw bosses. Moreover, the larger inside diameter screw bosses 41, 42 and 43 and 70° openings in the screw bosses in conjunction with the greater wall thickness of the screw bosses and the walls directly behind the screw bosses cooperate to eliminate any noticeable lines that sometimes occur behind the screw bosses in the standard hollow aluminum extrusions, which are aesthetically undesirable because they make it appear as if the fasteners are breaking out of the walls of the screw bosses.

Figure 4:
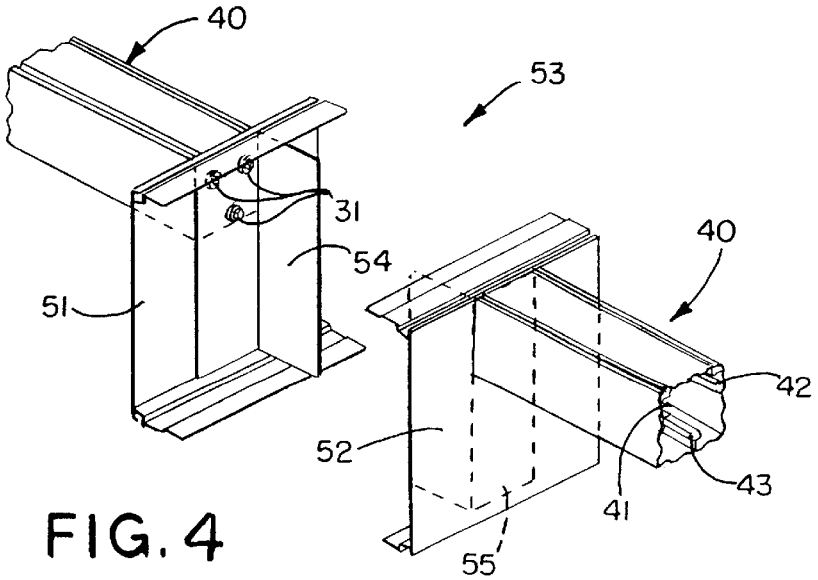
FIG. 4 is a fragmentary perspective view showing two hollow aluminum extrusions in accordance with the present invention anchored to two extruded aluminum sections of a self mating beam prior to mating the two extruded sections together.
Figure 5:
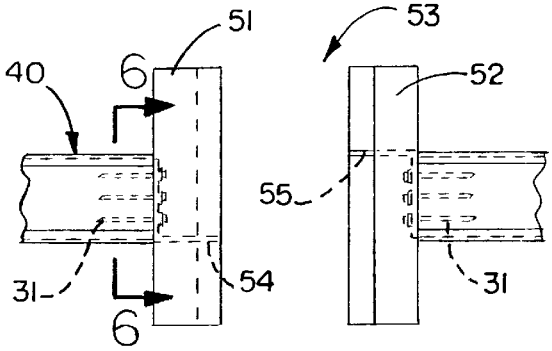
FIG. 5 is a top plan view of the two hollow aluminum extrusions and two extruded sections of FIG. 4.
Figure 6:
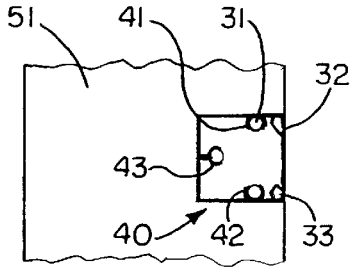
FIG. 6 is a transverse section through one of the hollow aluminum extrusions of FIG. 5 taken on the plane of the line 6—6 thereof.

FIGS. 4 through 6 schematically show the ends of two hollow aluminum extrusions 40 in accordance with the present invention anchored to two extruded aluminum sections 51 and 52 of a snap extrusion or of a self mating beam 53 prior to mating the two extruded sections together using three fasteners 31 extending through the sections into the three screw bosses 41 through 43 to make a rigid moment connection between these components of the structural frame. Suitable internal bracing in the form of extruded angles 54 and 55 are provided between the extruded aluminum sections 51 and 52 at the locations where the hollow aluminum extrusions 40 are anchored to the beam sections.

Figure 7:
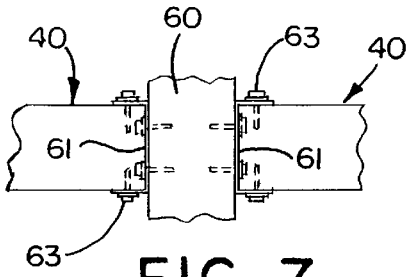
FIGS. 7 and 8 are fragmentary side elevation views showing two different ways of attaching two hollow aluminum extrusions in accordance with the present invention to opposite sides of another hollow aluminum extrusion.
Figure 8:
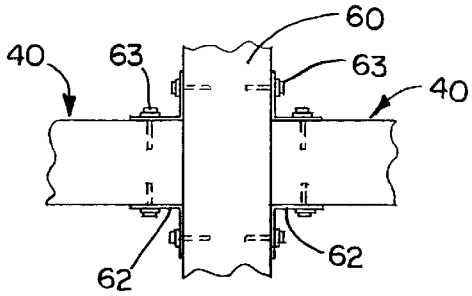

In some applications the ends of two hollow aluminum extrusions 40 of the present invention are anchored in line to opposite sides of other hollow aluminum extrusions 60 by attaching U clips 61 or angles 62 to opposite sides of the hollow aluminum extrusions 60 using suitable fasteners 63 and then inserting the ends of the hollow aluminum extrusions 40 into the U clips 61 or between the angles 62 and attaching the U clips/angles to opposite sides of the hollow aluminum extrusions 40 using additional fasteners 63 as schematically shown in FIGS. 7 and 8.

Figure 9:
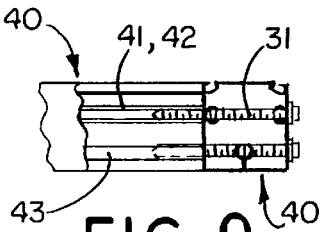
FIG. 9 is a fragmentary sectional view showing a hollow aluminum extrusion of the present invention connected to one side of an other hollow aluminum extrusion by running fasteners through the other hollow aluminum extrusion into three screw bosses in the hollow aluminum extrusion.

In other applications the ends of the hollow aluminum extrusions 40 of the present invention are anchored to one side only of other hollow aluminum extrusions 40 by running three fasteners 31 through the other hollow aluminum extrusions into the three screw bosses 41, 42 and 43 in the hollow aluminum extrusions of the present invention as schematically shown in FIG. 9.

Figure 10:
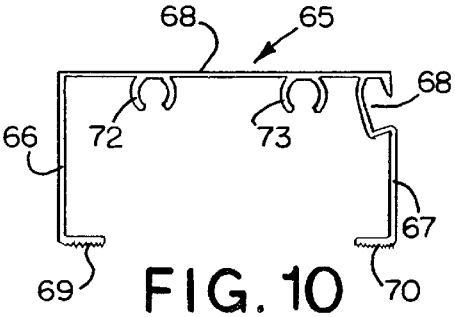
Figure 10A:
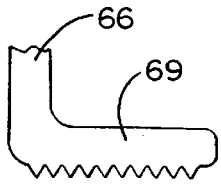
FIG. 10*a* is a further enlarged end view of one of the mounting legs of the open back aluminum extrusion of FIG. 10.

In still other applications the hollow aluminum extrusions 40 of the present invention are anchored to open back aluminum extrusions by running fasteners through the face of the open back aluminum extrusions into the screw bosses in the hollow aluminum extrusions. FIG. 10 shows a standard 1×2 open back aluminum extrusion 65 including a pair of side walls 66, 67 extending perpendicularly from the face 68 and a pair of relatively short inturned legs 69 and 70 on the outer ends of the side walls defining the open back 71. One of the side walls 67 has a spline groove 68 in the outer surface thereof to permit the splined edge of a screen (not shown) to be rolled into the spline groove.

On the inner surface of the face 68 of the industry standard open back extrusion 65 shown in FIG. 10 are a pair of screw bosses 72 and 73 that may be used to anchor the ends of the open back extrusions to other framing components by running fasteners through the other framing components into the screw bosses in the open back extrusions. However, since the open back aluminum extrusions are primarily used to hold screens on the outside of the enclosure, the open back aluminum extrusions are commonly secured to other structural components or existing structures simply by running suitable fasteners through the face of the open back aluminum extrusions into other structural components or existing structures. Moreover, these screw bosses 72 and 73 can be a hindrance when attaching the ends of hollow aluminum extrusions 40 to the face of open back aluminum extrusions in that the screw bosses on the open back aluminum extrusions prevent the heads and washers of the fasteners from being mounted flush against the inside surface of the face as further shown in FIG. 11, thus necessitating the use of longer fasteners than would otherwise be required.

Figure 11:
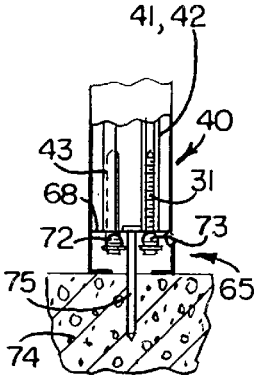
FIG. 11 is a fragmentary section showing one end of a hollow aluminum extrusion in accordance with the present invention attached to the face of a standard open back aluminum extrusion which is in turn attached to an existing support structure.

The open back aluminum extrusion 65 may be attached to a concrete base 74 or other existing structure after the hollow aluminum extrusions are secured to the open back aluminum extrusion by running suitable fasteners 75 through the face of the open back aluminum extrusion in spaced relation from the hollow aluminum extrusions and into the existing structure as further schematically shown in FIG. 11.

Figure 12:
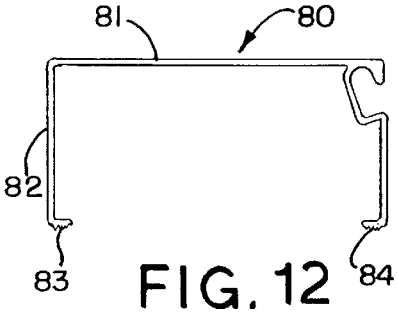
FIG. 12 is an enlarged end view of one form of open back aluminum extrusion in accordance with the present invention.
Figure 13:
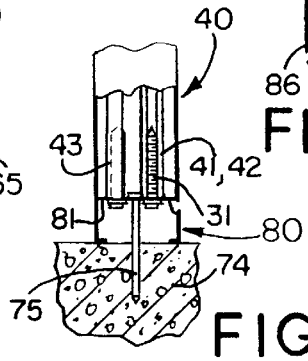
FIG. 13 is a fragmentary section showing one end of a hollow aluminum extrusion in accordance with the present invention attached to the face of an open back aluminum extrusion of the present invention which is in turn attached to an existing support structure.

One form of 1×2 open back aluminum extrusion 80 in accordance with the present invention is shown in FIG. 12 which is similar to the standard open back aluminum extrusion 65 shown in FIG. 10 including the same outside dimensions of 0.990 inch×01.98 inches. Also, the nominal wall thickness of the extrusion 80 may be the same as the standard extrusion 65 which in most cases is 0.036 inch but in certain applications may be of different nominal wall thicknesses. However, the internal screw bosses have been eliminated from the open back aluminum extrusion 80 of the present invention in order to provide a flat, uninterrupted inner surface on the face 81 of the open back aluminum extrusion. This makes it easier to drill fastener holes through the face in alignment with the screw bosses 41–43 in the hollow aluminum extrusions 40. Also this provides for the flush mounting of the heads and washers of the fasteners 31 against the inner surface of the face 81 of the hollow aluminum extrusion as schematically shown in FIG. 13, resulting in a stronger, more positive connection between the open back aluminum extrusion 80 and the hollow aluminum extrusions 40. Moreover, shorter fasteners 31 having a length for example of 1½ inches may be used to anchor hollow aluminum extrusions 40 to the open back aluminum extrusions 80 instead of the usual 2 inch fasteners.

Figure 12A:
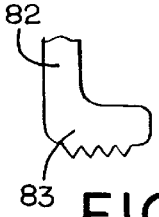
FIG. 12*a* is a further enlarged end view of one of the mounting legs of the open back aluminum extrusion of FIG. 12.
Figure 14:
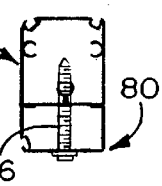
FIG. 14 is an end view showing an open back aluminum extrusion of the present invention attached to a hollow aluminum extrusion of the present invention by running fasteners through the face of the open back aluminum extrusion into the bottom wall of the hollow aluminum extrusion.

For ease of anchoring the hollow aluminum extrusions 40 of the present invention to the face 81 of the 1×2 open back aluminum extrusion 80 of the present invention, it is important to space the bottom wall screw boss 43 of the hollow aluminum extrusions 40 sufficiently inwardly from the bottom wall 47 in order to provide room for the head and washer of the fasteners 31 extending through the face of the open back aluminum extrusion into the bottom wall screw boss. Also, the width of the inturned legs 83 and 84 of the open back aluminum extrusion 80 of the present invention are reduced from the standard 0.250 inch width as schematically shown in FIGS. 10, 10*a* and 11 to 0.120 inch as schematically shown in FIGS. 12, 12*a* and 13 so that the legs do not interfere with the running of the fasteners through the face of the open back extrusion into the bottom wall screw boss. FIG. 14 shows the open back aluminum extrusion 80 of the present invention attached to the hollow aluminum extrusion 40 of the present invention by running suitable length fasteners 86 through the face of the open back aluminum extrusion into the bottom wall of the hollow aluminum extrusion.

To resist twisting or rocking of the hollow aluminum extrusion 40 of the present invention when fasteners are run into the three screw bosses of the hollow aluminum extrusion to make a rigid moment connection between the hollow aluminum extrusion and another aluminum framing component such as a snap extrusion or self mating beam, a U-shaped clip may be installed in the ends of the hollow aluminum extrusion before running the fasteners into the screw bosses. One such clip 90 is shown in FIGS. 15 and 16 installed in an end of the hollow aluminum extrusion 40 of the present invention by fasteners 91 extending through the side walls 44, 45 of the hollow aluminum extrusion and the legs 92, 93 of the clip with the end wall 94 of the clip positioned adjacent the end of the hollow aluminum extrusion.

The clip 90 is desirably extruded out of aluminum with legs 92, 93 approximately 2 to 2½ inches long. Also, the clip 90 is sized to closely fit between the three screw bosses 41, 42, 43 of the hollow aluminum extrusion 40 with the outer surfaces of the legs 92, 93 in closely spaced relation to the inner surfaces of the side walls 44, 45 of the hollow aluminum extrusion.

Figure 15:
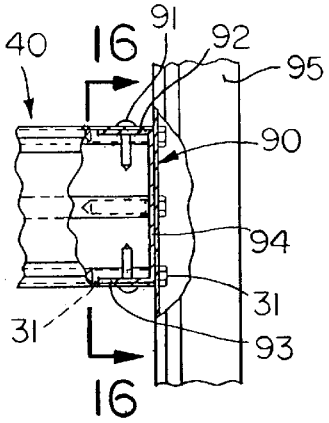
FIG. 15 is a fragmentary side elevation view showing the hollow aluminum extrusion of the present invention attached to a self mating beam, with a U-shaped internal clip fitted between the three screw bosses to prevent the hollow aluminum extrusion from twisting or rocking during torqueing of the fasteners into the hollow aluminum extrusion screw bosses.
Figure 16:
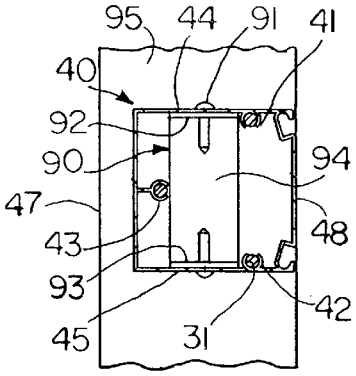
FIG. 16 is a transverse section through the hollow aluminum extrusion of FIG. 15 taken on the plane of the line 16—16 thereof.

When thus installed, the clips 90 will help to strengthen and rigidify the ends of the hollow aluminum extrusion 40 without interfering with the running of fasteners 31 into the screw bosses of the hollow aluminum extrusion during attachment of the ends of the hollow aluminum extrusion to other framing components such as the framing component 95 shown in FIGS. 15 and 16.

Figure 17:
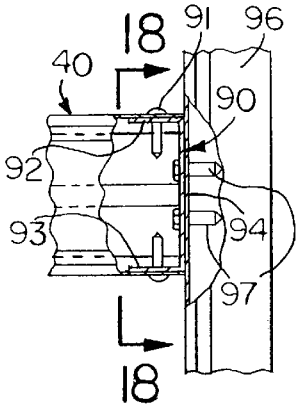
FIG. 17 is a fragmentary side elevation view showing the hollow aluminum extrusion of the present invention attached to an other hollow framing component using the U-shaped internal clip of FIGS. 15 and 16 fitted between the three screw bosses.
Figure 18:
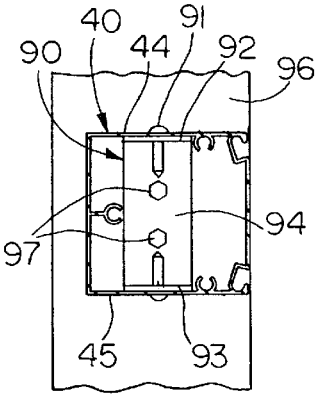
FIG. 18 is a transverse section through the hollow aluminum extrusion of FIG. 17 taken on the plane of the line 18—18 thereof.

These same clips 90 may also be used to attach the ends of the hollow aluminum extrusions 40 of the present invention to other hollow framing components 96 in the field for use as chair rails or the like as schematically shown in FIGS. 17 and 18. To that end, the clips 90 are first secured to the other framing components 96 by running suitable fasteners 97 through the end wall 94 of the clips into an adjacent wall of the other framing components. Next the ends of the hollow aluminum extrusions 40 are aligned with the clips 90 so that the clip legs 92, 93 will fit between the screw bosses 41, 42, 43 of the hollow aluminum extrusions as the ends of the hollow aluminum extrusions are pressed up against the wall of the other framing components. Then suitable fasteners 91 are run through the side walls 44, 45 of the hollow aluminum extrusions and legs 92, 93 of the clips to secure the ends of the hollow aluminum extrusions to the clips.

Figure 19:
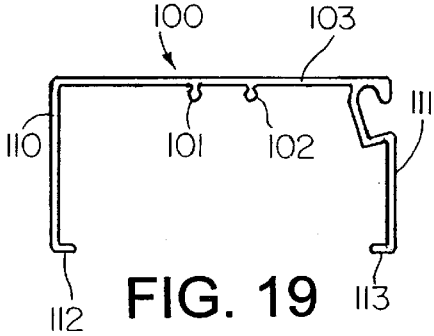
FIG. 19 is an enlarged end view of another form of open back aluminum extrusion in accordance with this invention which has a pair of closely spaced legs on the inner surface of the face of the extrusion for attaching a screw boss adapter to such extrusion.
Figure 20:
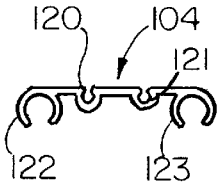
FIG. 20 is an enlarged end view of a screw boss adapter in accordance with the invention.
Figure 21:
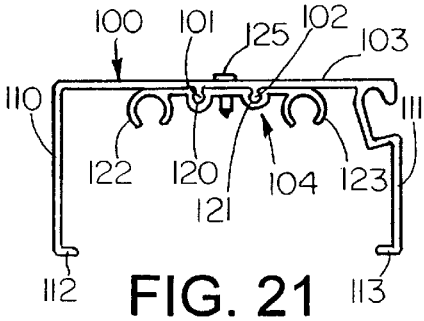
FIG. 21 is an enlarged end view of the screw boss adapter of FIG. 20 attached to the open back aluminum extrusion of FIG. 19.

Another form of open back aluminum extrusion 100 in accordance with this invention is shown in FIG. 19 which, like the open back aluminum extrusion 80 shown in FIG. 12, does not include any internal screw bosses. However, a pair of relatively small, laterally spaced legs 101, 102 are integrally formed on the inner surface of the face 103 of the open back aluminum extrusion 100 to permit relatively short lengths of screw boss adapters 104 to be attached to such inner surface as schematically shown in FIG. 21. This allows the open back aluminum extrusion of FIG. 19 to simulate the industry standard open back aluminum extrusion with screw bosses, by adding the screw boss adapters to permit fasteners to be used in internal horizontal fastening applications and when panel sections including such open back aluminum extrusions are fabricated at the factory rather than at the job site.

Using the open back aluminum extrusions 100 instead of the industry standard open back aluminum extrusions 65 results in a cost savings because of the relatively short length of the screw boss adapters and the fact that the screw boss adapters need only be added when needed. Also, because the open back aluminum extrusions 100 may be used with or without the screw boss adapters 104, they eliminate the need for a contractor having to stock both the industry standard open back aluminum extrusions 65 of FIG. 10 with screw bosses and the open back aluminum extrusions 80 of FIG. 12 without screw bosses.

Figure 27:
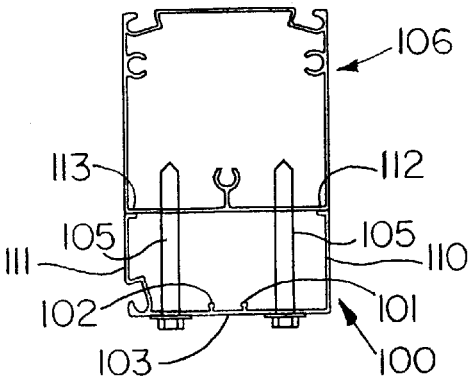
FIG. 27 is an end view showing the open back aluminum extrusion of FIG. 19 attached to the hollow aluminum extrusion of FIG. 3 by running two fasteners through the face of the open back aluminum extrusion into the bottom wall of the hollow aluminum extrusion spaced from the center of the face to eliminate possible slippage associated with center mounted fasteners.

The internal legs 101, 102 extend the full length of the open back aluminum extrusion 100 on opposite sides of the axial center of the face 103 of the open back aluminum extrusion to provide added rigidity in the area of the profile of the open back aluminum extrusion that is subject to a cave-in effect caused when fasteners 105 are run through the face of the hollow aluminum extrusion into another structural framing component 106 as shown, for example, in FIG. 27, and torqued with an automatic screw gun.

Figure 28:
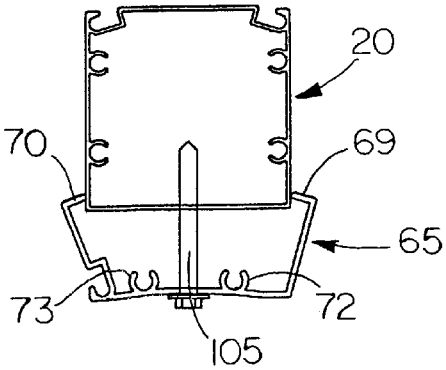
FIG. 28 is an end view showing the slippage problem associated with using a center mounted screw to attach the industry standard open back aluminum extrusion of FIG. 10 to the industry standard hollow aluminum extrusion of FIG. 2.

As also shown in FIG. 27, the internal legs 101, 102 are sufficiently small and spaced sufficiently close together to provide enough room between the legs and adjacent sides 110, 111 of the open back aluminum extrusion 100 to allow two such fasteners 105 to be used wherever desired to secure the open back aluminum extrusion to such other framing component 106 away from the center of the face of the open back aluminum extrusion without passing through the legs. This has the advantage that the load that is applied by the two spaced apart fasteners 105 will be sufficiently distributed to prevent slippage of the inturned ends 12, 113 of the open back aluminum extrusion 100 around the sides of the other framing component 106 which sometimes occurs when an industry standard open back aluminum extrusion 65 is attached to another framing component 20 using a center mounted fastener 105 extending between the screw bosses 72, 73 as schematically shown in FIG. 28.

Figure 24:
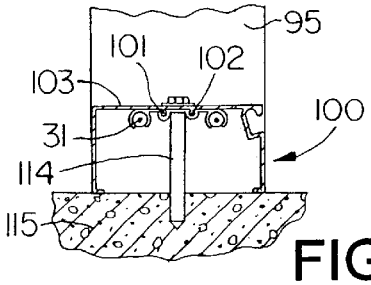
FIG. 24 is a transverse section similar to FIG. 23 but showing the open back aluminum extrusion attached to an existing support structure.
Figure 25:
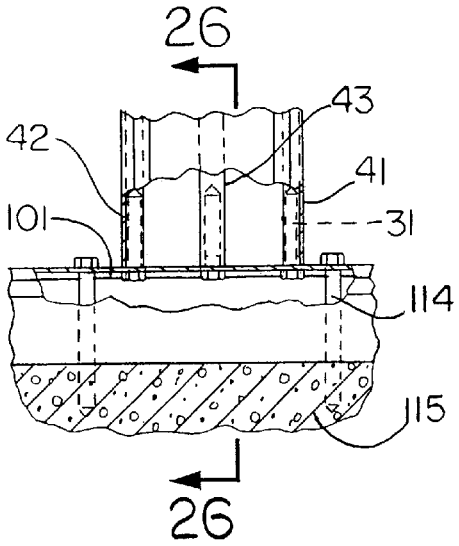
FIG. 25 is a fragmentary side elevation view, partly in section, showing one end of a hollow aluminum extrusion in accordance with this invention attached to the face of the open back aluminum extrusion of FIG. 19 which is then attached to an existing support structure.
Figure 26:
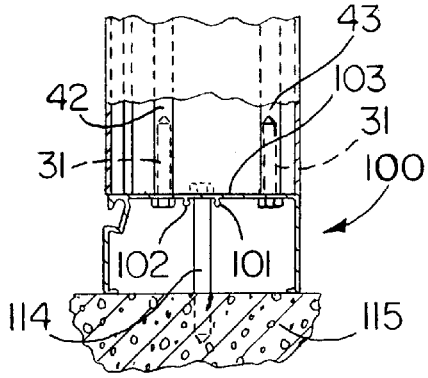
FIG. 26 is a fragmentary transverse section through the hollow aluminum extrusion and open back aluminum extrusion of FIG. 25 taken on the plane of the line 26—26 thereof.

At the same time, the lateral spacing between the internal legs 101, 102 of the open back aluminum extrusion 100 is sufficient to accept suitable fasteners 114 therebetween for attaching the open back aluminum extrusion to a concrete base or other existing structure 115 as schematically shown in FIGS. 24 through 26.

The screw boss adapters 104 are also made of extruded aluminum and may be cut to any desired length, for example, 2 to 2½ inches. On the back side of the screw boss adapters 104 are a pair of laterally spaced recesses 120, 121 shaped to engagingly receive the legs 102, 103 for selectively attaching the adapters 104 to the inner surface of the face 103 of the open back aluminum extrusion 100 either by snapping or sliding the adapters in place as schematically shown in FIG. 14. On the outer side of the adapters 104 are a pair of screw bosses 122, 123, one extending along each side of the adapters.

As previously indicated, the screw boss adapters 104 are typically only used when the open back aluminum extrusions 100 are to be used in the fabrication of panel sections at the factory and taken to the job site for final installation. The advantage in doing this is that the panel sections can be assembled much faster at the factory than they can on the job site.

Figure 22:
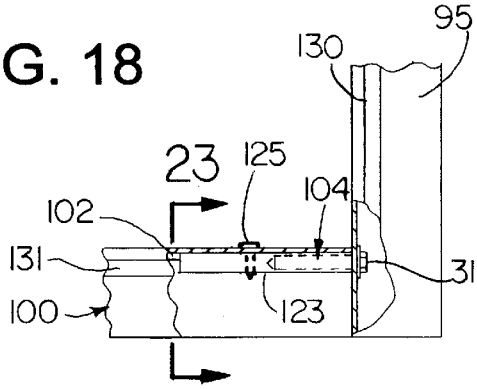
FIG. 22 is a fragmentary side elevation view showing the open back aluminum extrusion with screw boss adapter of FIG. 21 fastened to an upright member by screws extending through a wall of the upright member into the screw bosses of the adapter.
Figure 23:
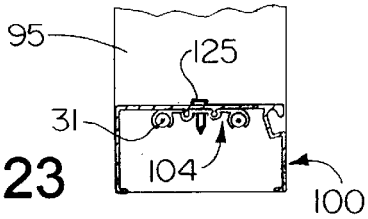
FIG. 23 is a transverse section through the open back aluminum extrusion of FIG. 22 taken on the plane of the line 23—23 thereof.

During fabrication of the panel sections at the factory, the screw boss adapters 104 are attached to the open back aluminum extrusions 100 as previously described and temporarily secured in place using small tek screws 125 as schematically shown in FIG. 21. This will prevent the screw boss adapters 104 from pulling out of the ends of the open back aluminum extrusions when the open back aluminum extrusions are secured at a 90° angle to other framing components 95 by running fasteners 31 through an adjacent wall of the other framing components into the adapter screw bosses 122, 123 as schematically shown in FIGS. 22 and 23. Then suitable screen material or the like (not shown) is rolled into the spline grooves 130, 131 of the framing components 95, 100 which will hold the panel sections together until they are taken to a job site and secured to a concrete base or other existing structure 115. This involves removing the temporary tek fasteners 125 and running suitable fasteners 114 through the same holes as well as additional holes in the face of the open back aluminum extrusion 100 between the two legs 101, 102 as schematically shown in FIG. 24.

Mounting screw boss adapters 104 to the inner surface of the face 103 of the open back aluminum extrusions 100 has the further advantage of providing increased wall thickness at the attachment points thus adding shear protection during tightening of the fasteners into the screw boss adapters, lessening cave-in effect, and providing reinforcement to the upright connections of the panel sections.

If the panel sections are built on the job, the open back aluminum extrusions 100 without the screw boss adapters 104 may be attached directly to existing structures and vertical uprights by placing the inturned legs 112 of the open back aluminum extrusions 100 against such existing structures 115 (and uprights) and running suitable fasteners 114 through the face of the open back aluminum extrusions between the legs 101, 102 into the existing structures (and uprights) as schematically shown in FIGS. 25 and 26. Before attaching the open back aluminum extrusions 100 to such existing structures, the ends of hollow aluminum extrusions 40 may be attached to the face 103 of the open back aluminum extrusions 100 by running fasteners 31 through the face of the hollow aluminum extrusions outwardly of the legs 101, 102 and into the screw bosses 41, 42, 43 of the hollow aluminum extrusions with the heads and washers of the fasteners flush up against the inner surface of the face of the open back aluminum extrusions as further shown in FIGS. 25 and 26.

Although the invention has been shown and described with respect to certain embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. An aluminum framing component for use in constructing pool, patio and glass enclosures comprising a hollow aluminum extrusion having top and bottom walls and two side walls and longitudinally extending internal screw bosses formed on inner surfaces of a plurality of said walls, and a U-shaped clip having an end wall and a pair of spaced apart legs extending from opposite ends of said end wall, said legs being fitted between said screw bosses, and fasteners securing said legs to two of said extrusion walls with said end wall of said clip positioned adjacent an end of said hollow aluminum extrusion.

2. The aluminum framing component of claim 1 in combination with an other hollow framing component, said end of said hollow aluminum extrusion being secured to said other framing component by fasteners extending through said end wall of said clip into an adjacent wall of said other framing component.

3. The aluminum framing component of claim 1 in combination with an other hollow framing component, said end of said hollow aluminum extrusion being secured to said other framing component by fasteners extending through an adjacent wall of said other framing component into said screw bosses of said hollow aluminum extrusion.

4. The aluminum framing component of claim 1 wherein said hollow aluminum extrusion has a total of three of said screw bosses, one of said screw bosses being integral with an inner surface of said bottom wall intermediate a width of said bottom wall below the center of gravity of said hollow aluminum extrusion, and the other two screw bosses being integral with inner surfaces of said side walls above the center of gravity of said hollow aluminum extrusion.

5. The aluminum framing component of claim 4 wherein said bottom wall screw boss is spaced from said bottom wall by a stem that is integral with said bottom wall screw boss and said bottom wall.

6. The aluminum framing component of claim 2 wherein said other framing component comprises a hollow post.

7. The aluminum framing component of claim 6 wherein said post is a hollow aluminum extrusion.

8. An aluminum framing component for use in constructing pool, patio and glass enclosures comprising an aluminum extrusion having a face, two side walls and an open back, said face having inner and outer surfaces, a screw boss adapter having at least one screw boss for receiving a fastener, and means for selectively attaching said adapter to said inner surface of said face at an end of said extrusion.

9. The aluminum framing component of claim 8 wherein said adapter has two laterally spaced screw bosses for receiving fasteners.

10. The aluminum framing component of claim 8 wherein said means for selectively attaching comprises at least one leg integral with said inner surface of said extrusion face, and a recess in said adapter shaped to engageably receive said leg.

11. The aluminum framing component of claim 10 wherein said adapter is axially slidable along said leg.

12. The aluminum framing component of claim 11 wherein said adapter is secured against axial movement along said leg by a fastener extending through said extrusion face into said adapter.

13. The aluminum framing component of claim 8 wherein said adapter is relatively short in relation to the overall length of said extrusion.

14. The aluminum framing component of claim 13 wherein said adapter is approximately two to three inches in length.

15. The aluminum framing component of claim 8 wherein said means for selectively attaching comprises a pair of laterally spaced legs integral with said inner surface of said extrusion face, and a pair of laterally spaced recesses in said adapter shaped to engageably receive said legs.

16. The aluminum framing component of claim 15 wherein said legs are on opposite sides of the axial center of said extrusion face with just enough space therebetween to accept a fastener therebetween.

17. The aluminum framing component of claim 16 wherein there is sufficient spacing between said legs and the adjacent side walls of said extrusion to accept two fasteners extending through said extrusion face from the interior of said extrusion without said adapter for securing said extrusion to an other framing component.

18. A system of framing components for use in constructing pool, patio and glass enclosures comprising an aluminum extrusion having a face, two side walls and an open back, said face having inner and outer surfaces, a separate adapter attached to said inner surface of said extrusion face adjacent an end of said extrusion, said adapter having at least one axially extending screw boss, and a fastener extending through an adjacent wall of an other framing component into said screw boss in said adapter for securing said end of said extrusion to said other framing component.

19. The system of claim 18 wherein said inner surface of said extrusion face has at least one integral leg extending axially along said inner surface, and said adapter has a recess shaped to engageably receive said leg.

20. The system of claim 19 wherein said adapter is axially slidable along said leg, further comprising a fastener extending through said extrusion face and into said adapter for fixing said adapter against movement along said leg.

21. The system of claim 18 wherein said adapter is relatively short in relation to the overall length of said extrusion.

22. The system of claim 21 wherein said adapter is approximately two to three inches in length.

23. The system of claim 18 wherein said inner surface of said extrusion face has a pair of laterally spaced axially extending legs integral with said inner surface, and said adapter has a pair of laterally spaced axially extending recesses shaped to engageably receive said legs.

24. The system of claim 23 wherein said legs are on opposite sides of the axial center of said extrusion, with sufficient spacing between said legs for passage of a fastener through said face between said legs and into said adapter.

25. The system of claim 18 wherein said adapter has two laterally spaced axially extending screw bosses, and two fasteners extend through said adjacent wall of said other framing component into said screw bosses in said adapter for securing said end of said extrusion to said other framing component.

26. A system of framing components for use in constructing pool, patio and glass enclosures comprising an aluminum extrusion having a face, two side walls and an open back, said face having inner and outer surfaces, a pair of laterally spaced axially extending legs integral with said inner surface of said extrusion face on opposite sides of the axial center of said extrusion face, an other framing component having a wall engaging inturned flanges at said open back of said extrusion, and fasteners extending through said extrusion face between each of said legs and the respective side walls of said extrusion into said wall of said other framing component for securing said extrusion to said other framing component.

27. A system of aluminum framing components for use in constructing pool, patio and glass enclosures comprising a first aluminum extrusion having a face, two side walls and an open back, said face having inner and outer surfaces, a pair of laterally spaced axially extending legs integral with said inner surface of said face on opposite sides of the axial center of said face, and a second aluminum extrusion having an end engaging said outer surface of said face of said first extrusion, said second extrusion having top and bottom walls and two side walls and longitudinally extending screw bosses formed on inner surfaces of a plurality of said walls of said second extrusion, and fasteners extending through said face of said first extrusion in spaced relation from said legs and into said screw bosses in said second extrusion for securing said second extrusion to said first extrusion, said fasteners having heads that are flush mounted against said inner surface of said face.

28. The system of claim 27 wherein said open back of said first extrusion has inturned flanges engaging an existing structure, and fasteners extend through said face of said first extrusion between said legs into an existing structure for securing said first extrusion to the existing structure.

29. The system of claim 27 wherein said second extrusion has a total of three longitudinally extending internal screw bosses, one of said screw bosses being integral with an inner surface of said bottom wall intermediate the width of said bottom wall below the center of gravity of said second extrusion, and the other two screw bosses being integral with inner surfaces of said side walls above the center of gravity of said second extrusion, said first extrusion having three fasteners extending through said face into said three screw bosses in said second extrusion for securing said second extrusion to said first extrusion, said three fasteners being flush mounted against said inner surface of said face.

30. The system of claim 29 wherein said bottom wall screw boss is spaced from said bottom wall of said second extrusion by a stem integrally connecting said bottom wall screw boss to said bottom wall to provide clearance for a head and washer of said fastener extending through said face of said first extrusion into said bottom wall screw boss.

* * * * *